US008199881B2

(12) United States Patent
Kim et al.

(10) Patent No.: US 8,199,881 B2
(45) Date of Patent: Jun. 12, 2012

(54) DISCRETELY ADDRESSABLE LARGE-AREA X-RAY SYSTEM

(75) Inventors: Dae Jun Kim, Daejeon (KR); Yoon Ho Song, Daejeon (KR); Jin Woo Jeong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 245 days.

(21) Appl. No.: 12/739,204

(22) PCT Filed: Nov. 13, 2008

(86) PCT No.: PCT/KR2008/006684

§ 371 (c)(1),
(2), (4) Date: Apr. 22, 2010

(87) PCT Pub. No.: WO2009/078582

PCT Pub. Date: Jun. 25, 2009

(65) Prior Publication Data

US 2010/0260321 A1 Oct. 14, 2010

(30) Foreign Application Priority Data

Dec. 17, 2007 (KR) ..... 10-2007-0132603

(51) Int. Cl.
*H01J 35/00* (2006.01)

(52) U.S. Cl. ..... 378/122; 378/119

(58) Field of Classification Search ..... 378/119–122
See application file for complete search history.

(56) References Cited

U.S. PATENT DOCUMENTS

2002/0110220 A1 8/2002 Shen et al.
2006/0274889 A1 12/2006 Lu et al.

FOREIGN PATENT DOCUMENTS

KR 10-2004-0057866 A 7/2004
KR 10-2004-0085163 A 10/2004
KR 10-2006-0088196 A 8/2006
KR 10-2007-0007512 A 1/2007
WO WO-03/063195 A1 7/2003

OTHER PUBLICATIONS

J. Zhang et al., "Multiplexing radiography using a carbon nanotube based x-ray source", Applied Physics Letter, vol. 89, pp. 064106-1-064106-3, Aug. 9, 2006.

*Primary Examiner* — Courtney Thomas
(74) *Attorney, Agent, or Firm* — Rabin & Berdo, P.C.

(57) ABSTRACT

A discretely addressable large-area X-ray system is provided. The large-area X-ray system can output a uniform flux of X-rays over a large area using discrete addressing operation of transistors connected to cathodes of electron emitters. Thus, when applied to a medical device, the system can minimize damage inflicted upon the human body because it enables effective imaging of only a desired specific portion of the body. Furthermore, the large-area X-ray system can be simply implemented by current switching using transistors. Thus, the system can be very easily applied to other applications.

13 Claims, 5 Drawing Sheets

[Fig. 1]
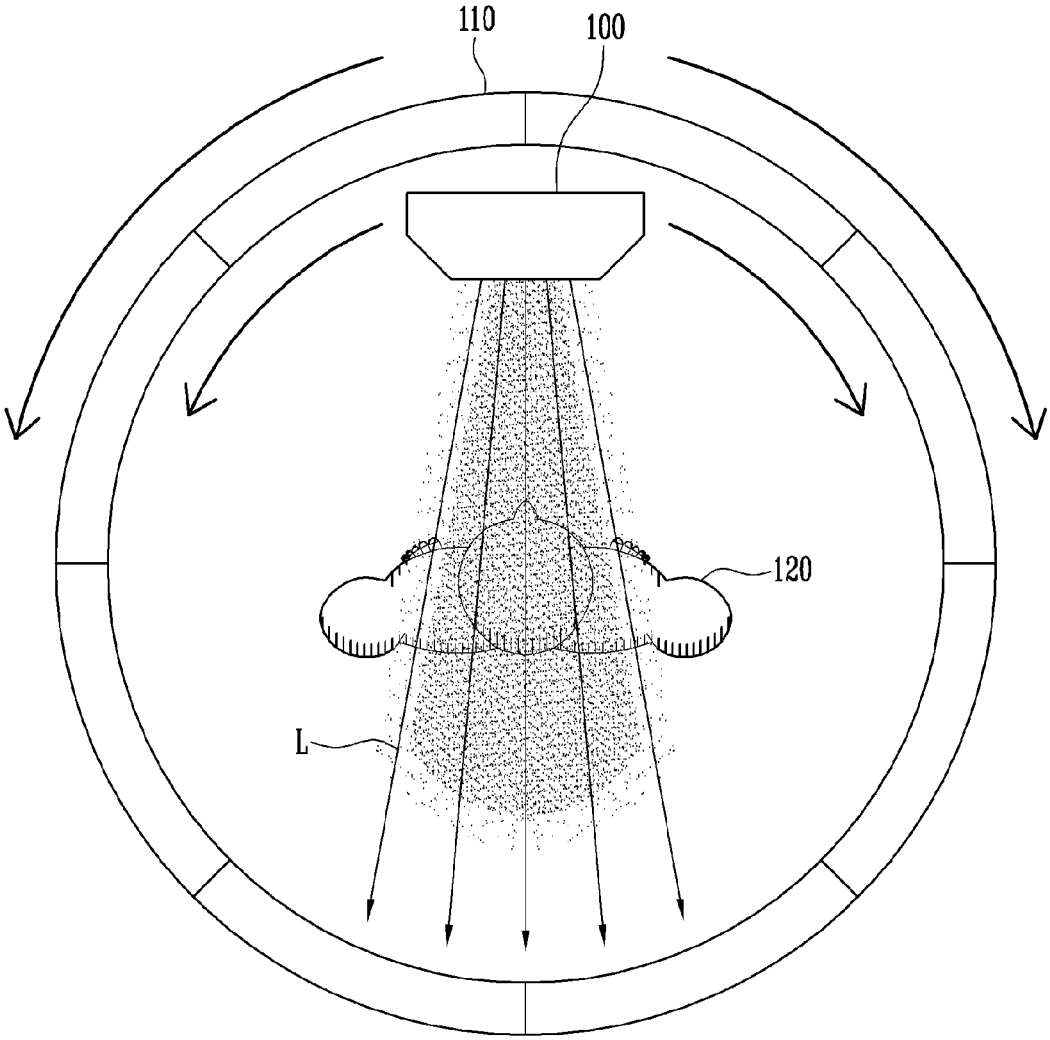

[Fig. 2]
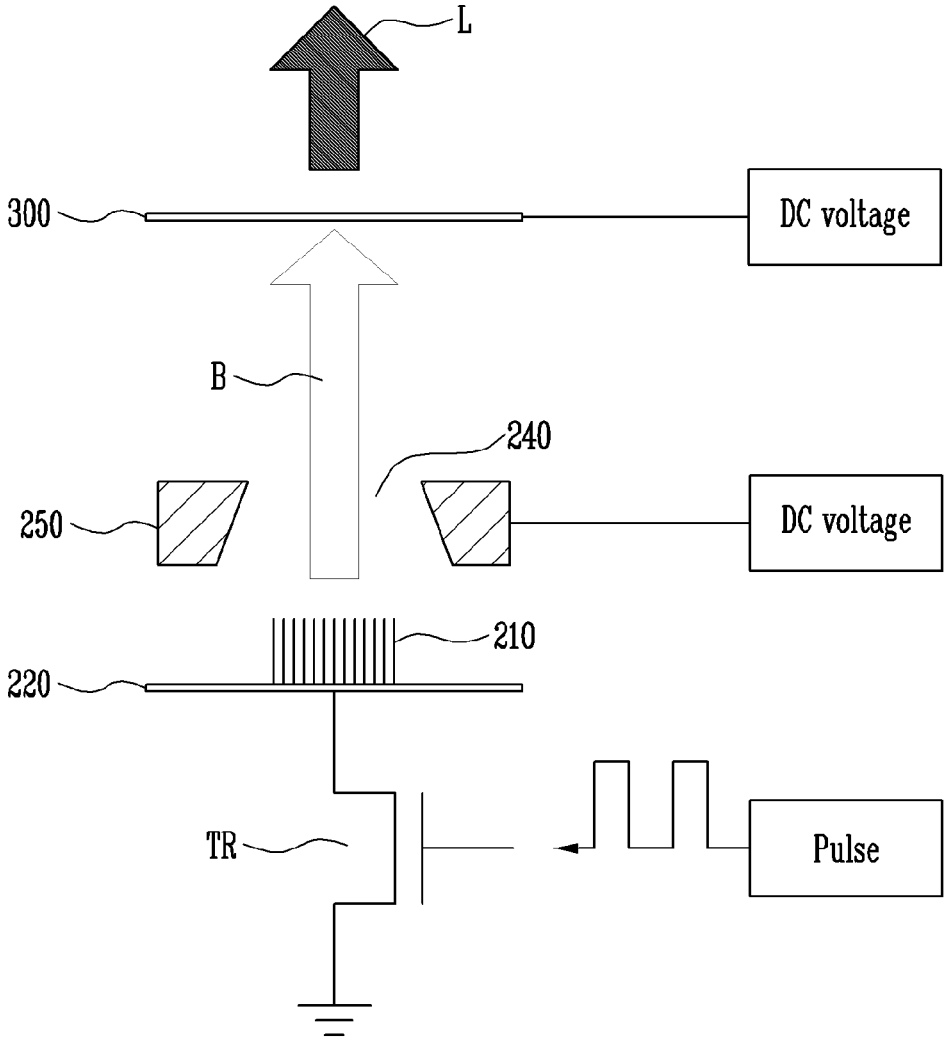

[Fig. 3]
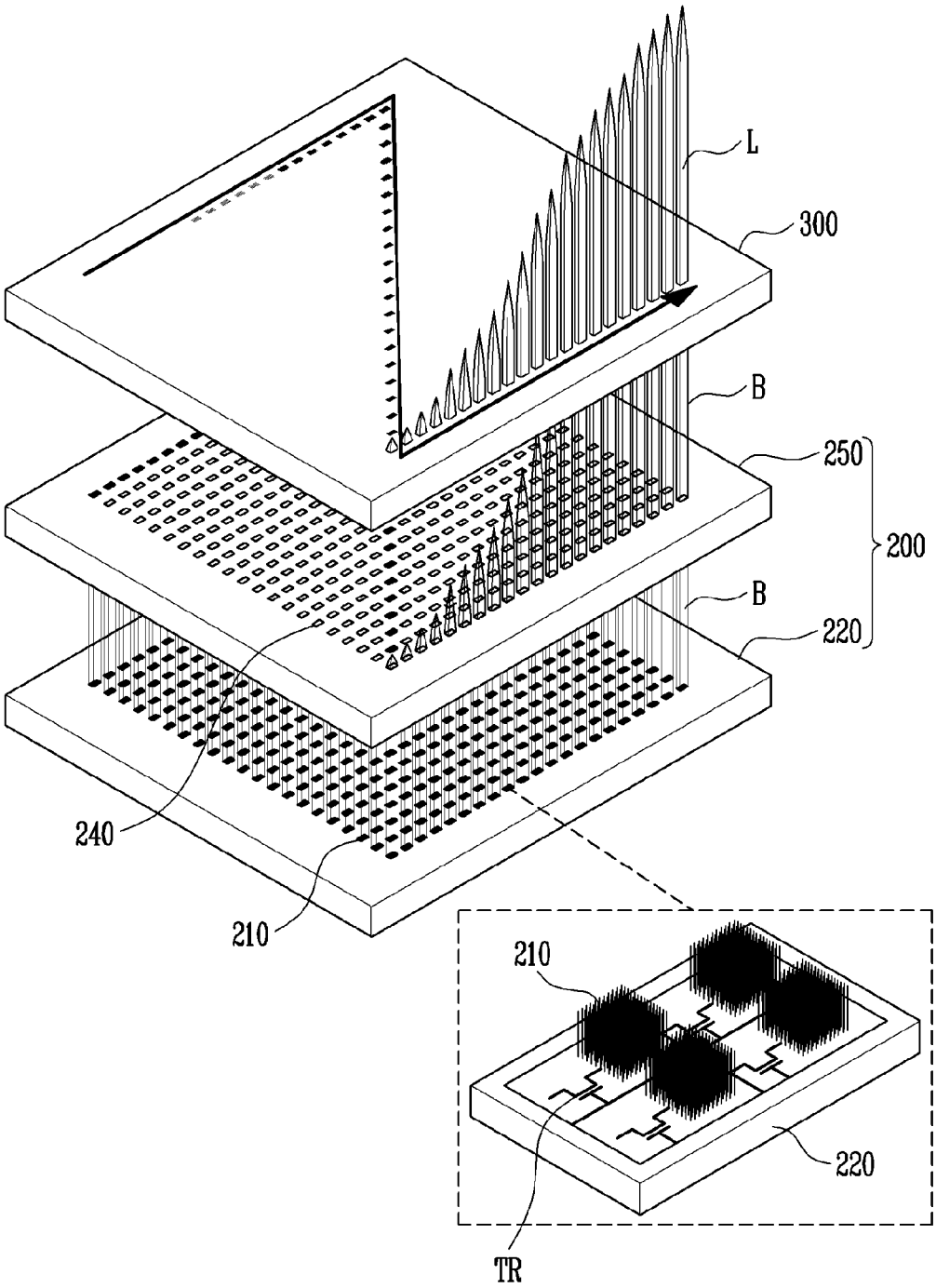

[Fig. 4]
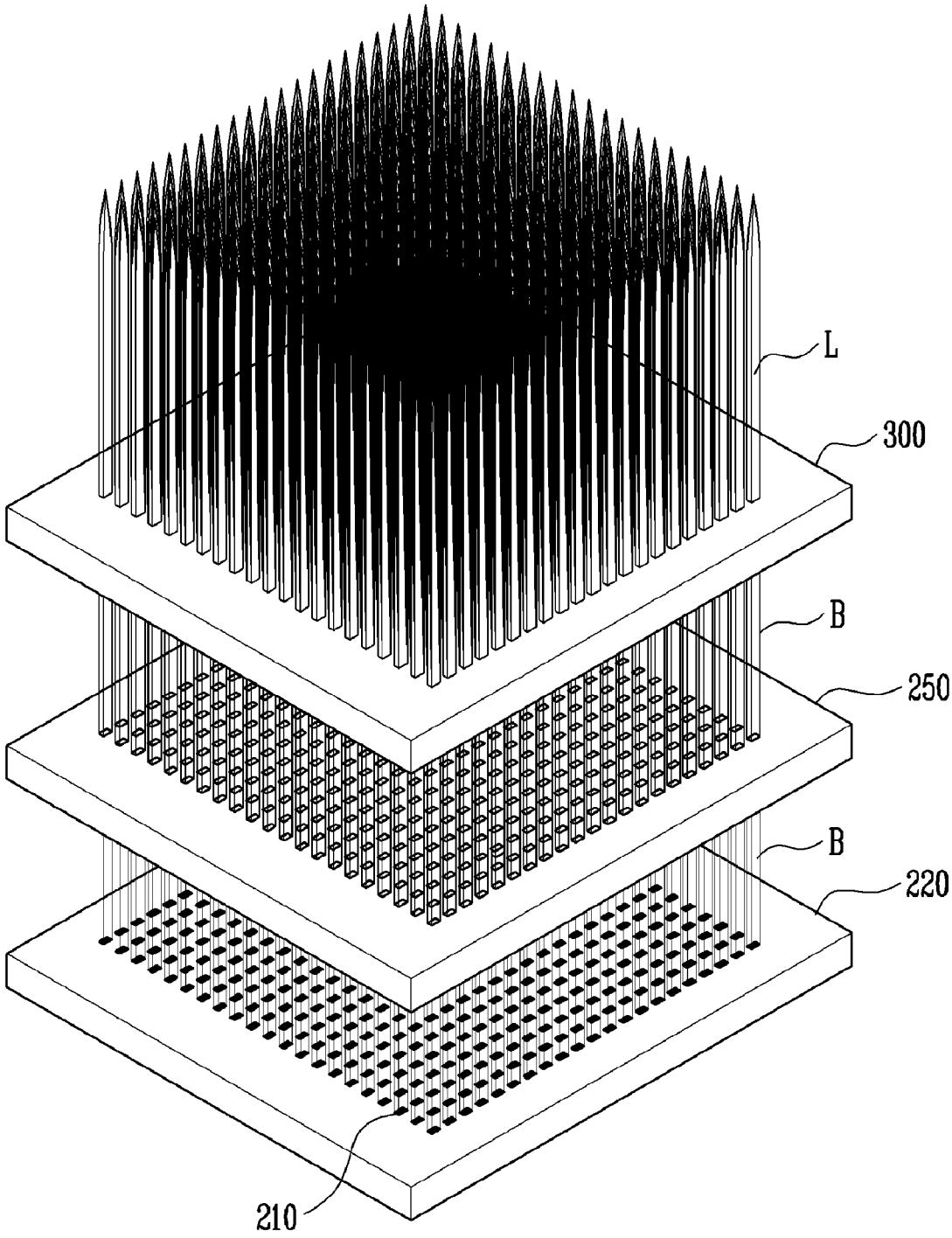

[Fig. 5]
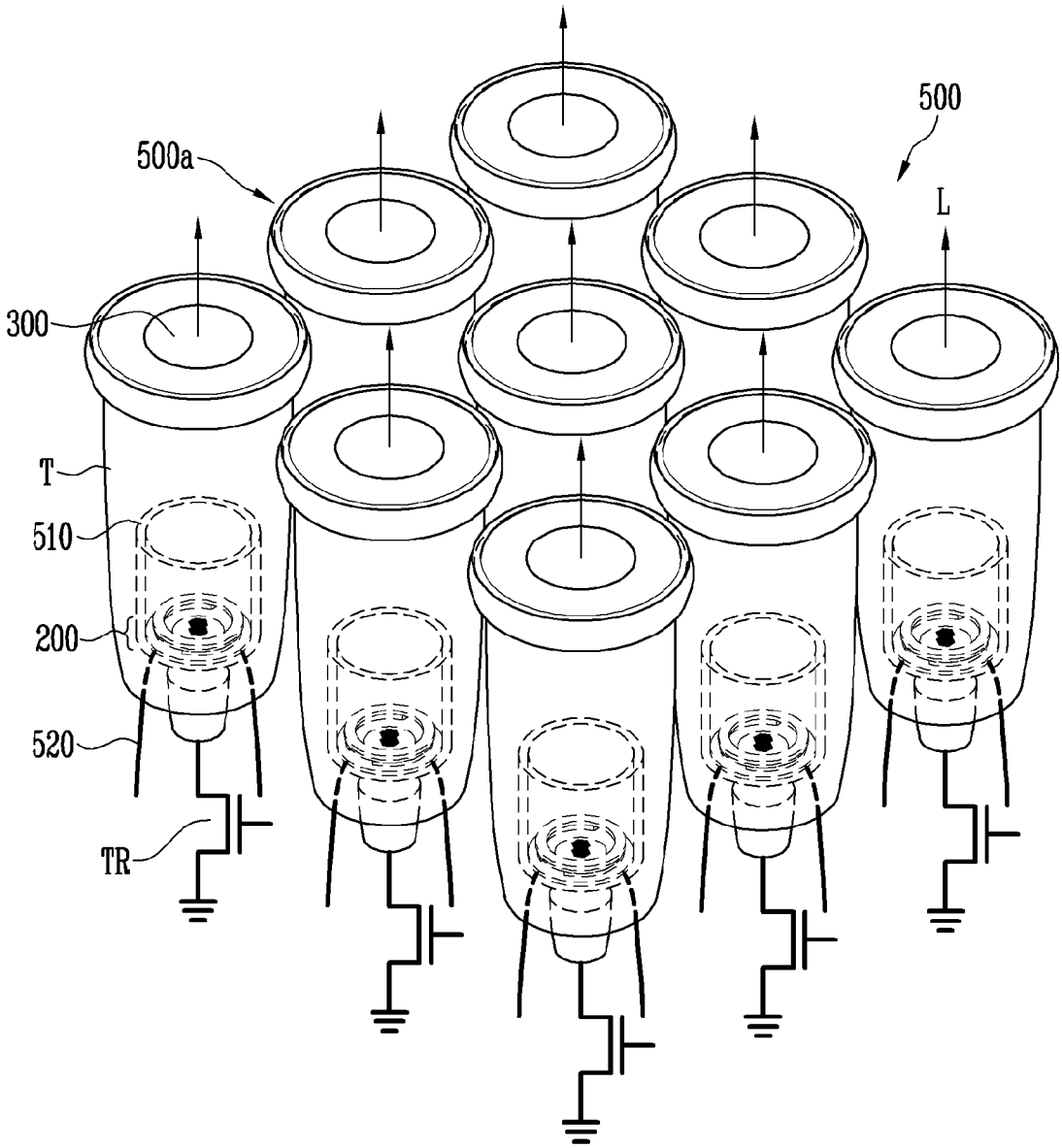

DISCRETELY ADDRESSABLE LARGE-AREA X-RAY SYSTEM

TECHNICAL FIELD

The present invention relates to a discretely addressable large-area X-ray system, and more particularly, to a large-area X-ray system capable of outputting a uniform flux of X-rays over a large area by discretely addressing each of a plurality of current switching transistors connected to a cathode of an electron emitter.

BACKGROUND ART

A large-area X-ray system may be suitable for various applications, including safety systems for detailed industrial inspections, quality control, analysis and measurement, and detailed aviation safety inspections, and medical applications such as Computed Tomography (CT).

However, in a typical large-area X-ray system, it is very difficult to achieve a uniform distribution and flux of X-rays over a large area. Accordingly, the large-area X-ray system includes a physically moving system, which increases the size of the X-ray system and greatly degrades its structural efficiency.

A current X-ray source typically uses a thermal electron emitting system using a filament, and thermal electron emission requires very high operation temperature (typically, about 1500° C.). The high operation temperature shortens the lifespan of the filament and leads to a very slow response time (since time is required to warm up the filament prior to emission), high energy consumption, and a large size. In particular, in medical applications, X-rays are continuously emitted for longer than necessary due to the slow response time of thermal electron emission, thus irradiating the human body more than necessary.

FIG. 1 is a schematic cross-sectional view of a CT system taken as an example of a conventional large-area X-ray system.

Here, an X-ray source 100 rotates around an object 120, as indicated by an arrow, because of its small area. A detecting device 110 moves with the X-ray source 100.

According to this CT design, a complex mechanical system included in a scanning system increases the size of the CT system. Since X-rays L are continuously emitted from the X-ray source 100 as described above, a target 120 is irradiated for a long time upon large-area imaging.

A conventional thermal electron emission X-ray system using a filament has a dipolar structure having a cathode and an anode (i.e., a diode structure). More specifically, when electrons are emitted from the cathode, a high voltage is applied to the anode to accelerate the electrons. Accordingly, it is difficult to focus and control the electrons. In addition, isotropic emission of thermal electrons from the filament is conducive to inefficient collection of the electrons at the anode.

To solve these problems, recently, nano emitters such as a Carbon Nano Tube (CNT) have been widely used. The nano emitters are conductive emitters having a sharp end and obeying a field emission principle whereby the emitter emits electrons in a vacuum state in response to an electric field. The nano emitters emit electrons straight in the direction of the electric field, with excellent performance and very high efficiency.

A typical field emission X-ray system using nano emitters has a triode structure including an anode, a cathode, and a gate for inducing electron emission. However, if electrons from the nano emitters leak to the gate, the gate is thermally deformed by leakage current, degrading electron emission reliability.

In particular, since the flux of electrons emitted from the Nano emitters is not uniform, the system is unsuitable for a large area. Accordingly, typical multiple X-ray tubes using Nano emitters cannot be arranged for a large area because the tubes output a different flux of X-rays.

Even though the nano emitters are formed on a single plate having a large area, the flux of emitted electrons is not uniform across the electron beam emission area. Accordingly, it is difficult to implement an X-ray system capable of uniformly emitting electron beams over a large area.

In addition, a conventional scheme of adjusting the flux of emitted electrons through gate adjustment has the drawback of requiring a high driving voltage, in addition to the above problem of uniformity.

DISCLOSURE OF INVENTION

Technical Problem

The present invention is directed to a large-area X-ray system that is discretely addressable and capable of outputting a uniform flux of X-rays over a large area through current switching of transistors.

Technical Solution

The present invention provides a discretely addressable large-area X-ray system including: an electron emitter including a cathode having a plurality of fine patterned nano emitters, and a gate for focusing electrons emitted from the nano emitters; and an anode disposed over the electron emitter for accelerating and colliding the electrons emitted from the nano emitters to generate X-rays, wherein the gate and the anode are formed on a single substrate having a large area, the cathode includes a plurality of transistors, each transistor being connected to each nano emitter.

Here, an amount of electrons emitted from the nano emitters and the resulting flux of X-rays output from the anode may depend on a pulse voltage applied to the gate of each transistor. Electrons may be emitted from some or all of the nano emitters and the X-rays may be discretely addressed and output from the anode according to discrete addressing of the respective transistors. Since the flux of emitted electrons depends on an output characteristic of each transistor, X-rays may be output with a uniform flux distribution over an entire area of the large-area anode.

The present invention also provides a discretely addressable large-area X-ray system including a plurality of discrete X-ray elements, wherein each discrete X-ray element includes: an electron emitter including a cathode having a plurality of fine patterned nano emitters, and a gate for focusing electrons emitted from the nano emitters; an anode disposed over the electron emitter for accelerating and colliding the electrons emitted from the nano emitters to generate X-rays; and a transistor connected to the cathode.

An amount of electrons emitted from the nano emitters and the resulting flux of X-rays output from the anode may depend on a pulse voltage applied to the gate of each transistor. The discretely addressable X-rays may be output with the same flux from each of the discrete X-ray elements according to the operation of the respective transistors included in the discrete X-ray elements.

ADVANTAGEOUS EFFECTS

According to the present invention, the large-area X-ray system that can be discretely addressed to output a uniform flux of X-rays over a large area using a current switching characteristic of the transistors connected to the cathode of the electron emitter is simple to implement.

Also, according to the present invention, it is possible to effectively image only a desired specific portion of a target. Thus, when applied to a medical device, the system can minimize damage inflicted upon the human body.

Furthermore, according to the present invention, a large-area X-ray system can be simply implemented by a connection of transistors. Thus, the system can be very easily applied to other applications.

BRIEF DESCRIPTION OF THE DRAWINGS

The above and other objects, features and advantages of the present invention will become more apparent to those of ordinary skill in the art by describing in detail exemplary embodiments thereof with reference to the attached drawings, in which:

FIG. 1 is a schematic cross-sectional view of a CT system taken as an example of a conventional large-area X-ray system;

FIG. 2 illustrates a discrete addressing principle in a large-area X-ray system according to the present invention;

FIG. 3 illustrates a large-area X-ray system according to a first exemplary embodiment of the present invention;

FIG. 4 illustrates uniform emission of X-rays in a discretely addressable large-area X-ray system according to the present invention; and FIG. 5 illustrates a discretely addressable large-area X-ray tube according to a second exemplary embodiment of the present invention.

DESCRIPTION OF MAJOR SYMBOL IN THE ABOVE FIGURES

200: Electron emitter
210: nano emitter
220: Cathode
240: Gate hole
250: Gate
300: Anode Mode for the Invention Hereinafter, a discretely addressable large-area X-ray system according to the present invention will be described in greater detail with reference to the accompanying drawings.

FIG. 2 illustrates a discrete addressing principle in a large-area X-ray system according to the present invention.

Referring to FIG. 2, a cathode 220 having fine patterned nano emitters 210 is connected to a drain of each transistor TR, a pulse voltage is applied to a gate of the transistor TR, and a source of the transistor TR is grounded.

When a DC voltage is applied across the anode 300 and the gate 250 so that electrons are emitted from the nano emitters 210 of the cathode 220, the emitted electrons are focused on and collided with the anode 300 through gate holes 240 of the gate 250, thus creating X-rays L. In this case, an amount of electrons emitted from the nano emitters 210 on the cathode 220 may be adjusted according to the pulse voltage applied to the gate of the transistor TR.

That is, when the cathode 220 is connected to the drain of the transistor TR and a pulse voltage is applied to the gate of the transistor TR, a current emitted from the nano emitters 210 on the cathode 220 is controlled by the cathode current, which is controlled by the applied pulse voltage. Thus, the output X-ray flux may be adjusted according to the pulse voltage applied to the gate of the transistor TR.

According to this principle, when a sufficient DC voltage to induce electron emission is applied to the gate 250, the amount of electrons emitted from the nano emitters 210 of the cathode 220 depends on only the pulse voltage applied to the gate of the transistor TR. Accordingly, a desired electron amount can be emitted with only pulse voltage adjustment. Furthermore, a width and a duty rate of the pulse voltage applied to the gate of the transistor TR can be adjusted to increase the lifespan of the nano emitters 210.

Although, in the present exemplary embodiment, the pulse voltage has been described as being applied to the gate of the transistor TR, a low voltage that causes a current passage of a channel in the transistor TR to be connected may be used depending on the application.

As a result, the flux distribution of X-rays L ultimately output from the discrete X-ray element can be adjusted by adjusting the amount of the emitted electrons. Accordingly, when multiple discrete X-ray elements are arranged to implement a large-area X-ray system, X-ray output fluxes of the respective discrete X-ray elements are equalized for a uniform output flux distribution of X-rays over a large area. Also, an X-ray system that is discretely addressable on an X-axis and a Y-axis by turning discrete X-ray elements in a specific portion on and discrete X-ray elements in other portions off may be implemented.

Here, the transistor TR for adjusting the amount of the emitted electrons may be a commercially available transistor, such as a high-voltage metal-oxide semiconductor field-effect transistor (MOSFET). It will be easily appreciated that, when a plurality of discrete X-ray elements in a large-area X-ray system have a very fine pitch, a thin film transistor (TFT) may be applied. The anode 300 for emitting X-rays L may be any existing anode, including a transmissive anode and a reflective anode.

FIG. 3 illustrates a large-area X-ray system according to a first exemplary Embodiment of the present invention.

Referring to FIG. 3, in the large-area X-ray system according to the present invention, a cathode 220, an anode 300, and a gate 250 form a single plate having a large area. Electrons, when emitted from nano emitters 210 of the cathode 220, are focused on the anode 300 through the gate 250 and collide with the anode 300, thus generating X-rays L. Here, the anode 300 may be transmissive or reflective.

That is, the gate 250 for inducing electron emission is included between the anode 300 and the cathode 220, resulting in a triode structure.

The cathode 220 and the gate 250 constitute an electron emitter 200. A structure of the electron emitter 200 will now be described in greater detail.

First, a plurality of nano emitters 210 are fine patterned on the cathode 220. In the present exemplary embodiment, the nano emitters 210 may be fine patterned on the cathode 220 using the following method.

First, CNT powder, organic binder, photosensitive material, monomer, and nano metallic particles are dispersed in a solvent to make a CNT paste. An electrode formed on a substrate is then coated with the CNT paste. The CNT paste coated on the electrode is then exposed and fine patterned. The fine patterned CNT paste is baked and surface-treated to activate its surface. Here, the substrate may be pre-patterned on the cathode 220 by exposure and development for fine patterning. The cathode 220 may include a substrate having any shape, such as circular. The substrate may be any material, including glass coated with ITO, or metal. When the CNT paste is fine patterned by exposure, it may be finely patterned to a size of at least 5 μm×5 μm, which is the limit for adhesion to the electrode. The metallic particles are added in a powder or paste form. The metallic particles may include high conductivity metal, such as Ag, Cu, Ru, Ti, Pd, Zn, Fe or Au.

The gate 250 has gate holes 240 having the same pitch as the nano emitters 210.

In particular, when a plurality of nano emitters 210 are arranged with a very fine pitch as shown in FIG. 3, the cathode 220 itself is implemented by TFTs and each nano emitter 210 is directly connected to a drain of the transistor TR constituting the TFT for both electron emission uniformity and discrete addressability, as illustrated in FIG. 2. Such a discretely addressable scheme may be the same as an addressing scheme of an active matrix display for a Thin Film Transistor-Liquid Crystal Display (TFT-LCD) or a Thin Film Transistor-Field Emission Display (TFT-FED).

That is, according to the discrete addressing operation of each transistor TR, an electron beam B and, accordingly, X-rays L from the anode 300 are discretely addressed and output. Furthermore, the X-rays L can be uniformly output over a large area by controlling the cathode current, which is controlled by the voltage applied to the gate of each transistor TR.

FIG. 4 illustrates uniform emission of X-rays in the discretely addressable large-area X-ray system according to the present invention. As shown in FIG. 4, a uniform flux of X-rays can be output over a large area.

Although the cathode 220, the gate 250, and the anode 300 have been described as forming a single plate having a large area, a large-area X-ray tube may be implemented by arranging multiple discrete X-ray tubes as X-ray sources. The large-area X-ray tube will now be described in greater detail with reference to FIG. 5.

FIG. 5 illustrates a discretely addressable large-area X-ray tube according to a second exemplary embodiment of the present invention.

Referring to FIG. 5, a large-area X-ray tube 500 according to the present invention includes a plurality of discrete X-ray tubes 500*a*. When electrons are emitted from an electron emitter 200 in a vacuum tube T of each discrete X-ray tube 500*a*, they are focused on and collided with an anode 300. Collision of the electrons with the anode 300 creates X-rays L.

Here, the electron emitter 200 is fixed to the vacuum tube T by a fixing member 510, and includes a gate (not shown) and a cathode (not shown). Each discrete X-ray tube 500*a* further includes two to four leads 520 for applying a voltage to the electron emitter 200.

This basic discrete X-ray tube structure is known.

Meanwhile, known discrete X-ray tubes, including thermal electron emission X-ray tubes and cold electron emission X-ray tubes, do not output X-rays with uniform flux.

For this reason, even though the large-area X-ray tube is implemented by arranging multiple discrete X-ray tubes, X-ray output fluxes of the discrete X-ray tubes are not the same. Accordingly, it is impossible to accomplish a uniform X-ray output flux over a large area.

Thus, the present invention uses the principle illustrated in FIGS. 2 to 4. That is, transistors TR having the same output characteristic are connected to the electron emitters 200 of the respective discrete X-ray tubes 500*a* for current switching. In this case, the transistor may be connected to a cathode (not shown) of the electron emitter 200, as shown in FIG. 2.

That is, output fluxes of the discrete X-ray tubes 500*a* may be equalized according to the current switching in the respective transistors TR. Thus, it is possible to implement a large-area X-ray tube 500 that is discretely addressable and produces uniform X-ray emission.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A discretely addressable large-area X-ray system comprising:

an electron emitter including a cathode having a plurality of fine patterned nano emitters, and a gate for focusing electrons emitted from the nano emitters; and an anode disposed over the electron emitter for accelerating and colliding the electrons emitted from the nano emitters to generate X-rays, wherein the gate and the anode are formed on a single substrate having a large area and the cathode includes a plurality of transistors, each transistor being connected to each nano emitter.

2. The system of claim 1, wherein each transistor has a drain connected to one of the plurality of nano emitters, a gate to which a pulse voltage is applied, and a grounded source.

3. The system of claim 1, wherein an amount of electrons emitted from the nano emitters and the resulting flux of X-rays output from the anode is controlled by the cathode current, wherein the cathode current is controlled by a pulse voltage applied to the gate of each transistor.

4. The system of claim 1, wherein electrons are emitted from some or all of the nano emitters and the X-rays are discretely addressed and output from the anode according to discrete addressing of the respective transistors.

5. The system of claim 1, wherein X-rays are output with a uniform flux distribution over an entire area of the large-area anode according to discrete addressing of the respective transistors.

6. The system of claim 1, wherein the nano emitters are fine patterned on the cathode through screen printing, exposure and development.

7. The system of claim 1, wherein the gate comprises a plurality of gate holes having the same pitch as the nano emitters.

8. A discretely addressable large-area X-ray system comprising a plurality of discrete X-ray elements, wherein each discrete X-ray element comprises:

an electron emitter including a cathode having a plurality of fine patterned nano emitters, and a gate for focusing electrons emitted from the nano emitters;

an anode disposed over the electron emitter for accelerating and colliding the electrons emitted from the nano emitters to generate X-rays; and a transistor connected to the cathode.

9. The system of claim 8, wherein the transistor comprises a metal-oxide semi-conductor field-effect transistor.

10. The system of claim 8, wherein the transistor has a drain connected to the cathode, a gate to which a pulse voltage is applied, and a grounded source.

11. The system of claim 8, wherein an amount of electrons emitted from the nano emitters and the resulting flux of X-rays output from the anode is controlled by the cathode current, wherein the cathode current is controlled by a pulse voltage applied to the gate of each transistor.

12. The system of claim 8, wherein the same flux of X-ray is output from the respective discrete X-ray elements according to discrete addressing of the respective transistors included in the discrete X-ray elements.

13. The system of claim 8, wherein each discrete X-ray element comprises an X-ray tube.

* * * * *